US007276862B2

(12) United States Patent
Kim et al.

(10) Patent No.: US 7,276,862 B2
(45) Date of Patent: Oct. 2, 2007

(54) STABILIZER CIRCUIT FOR HIGH-VOLTAGE DISCHARGE LAMP

(75) Inventors: Byung-Sun Kim, Seoul (KR); Kyung-Soo Seok, Suwon-si (KR)

(73) Assignee: Media Technology, Inc., Bucheon-si, Gyeonggi-do (KR)

( * ) Notice: Subject to any disclaimer, the term of this patent is extended or adjusted under 35 U.S.C. 154(b) by 0 days.

(21) Appl. No.: 11/317,708

(22) Filed: Dec. 22, 2005

(65) Prior Publication Data

US 2006/0138970 A1 Jun. 29, 2006

(30) Foreign Application Priority Data

Dec. 28, 2004 (KR) ..... 10-2004-0113743

(51) Int. Cl.
*G05F 1/00* (2006.01)

(52) U.S. Cl. ..... 315/291; 315/247; 315/224; 315/282; 315/289; 315/DIG. 4; 315/DIG. 5

(58) Field of Classification Search ..... 315/209 R, 315/219, 225, 224, 247, 244, 289, 276, 282, 315/291, 307, DIG. 4, DIG. 5, DIG. 7; 363/34, 363/37, 98, 132

See application file for complete search history.

(56) References Cited

U.S. PATENT DOCUMENTS 5,363,020 A * 11/1994 Chen et al. ..... 315/209 R
5,838,181 A * 11/1998 Hesterman ..... 327/175
5,932,976 A * 8/1999 Maheshwari et al. ..... 315/291
5,959,410 A * 9/1999 Yamauchi et al. ..... 315/209 R
6,023,132 A * 2/2000 Crouse et al. ..... 315/307
6,437,515 B1 * 8/2002 Kamoi et al. ..... 315/209 R

* cited by examiner

*Primary Examiner*—Haissa Philogene
(74) *Attorney, Agent, or Firm*—Century IP Group, Inc.; F. Jason Far-hadian, Esq.

(57) ABSTRACT

A stabilizer circuit for a high-voltage discharge lamp is provided. The stabilizer comprises an electromagnetic interference (EMI) filter; a rectifying unit; a power factor correction (PFC) circuit; a buck converter; a commutator; an igniter; a high-voltage discharge lamp; a current detector; a voltage detector; an igniter voltage controller for receiving the voltage output from the igniter and controlling the voltage when abnormality in the high-voltage discharge lamp occurs.

6 Claims, 2 Drawing Sheets

STABILIZER CIRCUIT FOR HIGH-VOLTAGE DISCHARGE LAMP

CROSS-REFERENCE TO RELATED APPLICATIONS

Pursuant to 35 U.S.C. § 119, this application claims the benefit of earlier filing date and right of priority to Korean Patent Application No. 10-2004-113743, filed Dec. 28, 2004, the content of which is hereby incorporated by reference herein in its entirety.

COPYRIGHT & TRADEMARK NOTICES

A portion of the disclosure of this patent document contains material, which is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is for providing an enabling disclosure by way of example and shall not be construed to limit the scope of this invention to material associated with such marks.

FIELD OF INVENTION

The present invention relates to a stabilizer for a high-voltage discharge apparatus, and more particularly to a stabilizer circuit for a high-voltage discharge apparatus such as a mercury lamp or a natrium lamp, for example.

BACKGROUND

Generally, a stabilizer for turning on a high-voltage discharge lamp has a structure in which a copper wire is wound around a silicon steel sheet. The lamp has great power dissipation of the silicon steel sheet core and the copper wire because it uses a frequency of 50 or 60 Hz. In addition, the lamp has great weight and volume, which makes it difficult to dispose and treat.

To solve these problems, several types of electronic stabilizers using semiconductor have been recently developed. All such stabilizers, however, may cause electromagnetic interference with peripheral devices or electric shock accident.

A related art stabilizer circuit for a high-voltage discharge lamp to solve such problems is shown in FIG. 1. Referring to FIG. 1, a buck converter 10 includes a transistor TR1, a Zener diode Z1, capacitors C6 and C7, diodes D1, D2 and D3, a voltage control logic IC2, and a transformer L1.

The buck converter 10 converts a 380V DC voltage to an AC voltage, boosts the AC voltage, and converts the boosted AC voltage to a DC voltage. The system reference voltage generator 12 includes resistors R23, R24 and R25 and a Zener diode Z3. The system reference voltage generator 12 generates a set reference voltage Vref.

A commutator 14 includes a pulse width modulation controller IC3, capacitors C13, C14, C15 and C16, resistors R26 and R27, and transistors TR2, TR3, TR4 and TR5. The commutator 14 receives the converted DC voltage from the buck converter 10 and controls to supply constant current to an igniter 16. The igniter 16 includes a capacitor C2, a diode D2, a coil L2, a transformer L3, Zener diodes Z4, Z5, Z6 and Z7. The igniter 16 receives the voltage from the commutator 14 and generates a high voltage to apply the high voltage to a high-voltage discharge lamp 18.

The high-voltage discharge lamp 18 is turned on by the high voltage generated by the igniter 16. A current detector 20 detects an amount of current using resistors R1, R2 and R3 when the high voltage is fed back from the igniter 16. A voltage detector 22 detects the voltage outputted from the buck converter 10 using resistors R6 and R7.

A watchdog timer 24 includes resistors R12, R13, R14, and R15, capacitors C5 and C8, a transistor TR6, and an operational amplifier OP1. The watchdog timer 24 compares the detected voltage with the reference voltage generated by the reference voltage generator 12 and outputs a pulse for sensing abnormality in the high voltage at set time intervals.

A current and voltage error sensor 26 includes resistors R4, R5, R10, R11, R17, R18 and R19, capacitors C9, C10 and C11, a Zener diode Z2, and a voltage and current control logic IC1. The current and voltage error sensor 26 receives the current value detected by the current detector 20, the voltage value detected by the voltage detector 22 and the pulse signal output from the watchdog timer 24 to sense voltage and current error states.

An igniter voltage controller 28 includes resistors R20, R21 and R22, a capacitor C12, and an operational amplifier OP2. The igniter voltage controller 28 controls the application of a constant voltage to the igniter 16. The conventional stabilizer circuit for the high-voltage discharge lamp described above is available in capacity of 70 to 140 W. However, in high capacity exceeding for example 250 W, current increases, damaging the voltage control logic IC2 of the buck converter 10.

SUMMARY OF THE INVENTION

Therefore, the present invention is directed to provide a stabilizer circuit for a high-voltage discharge apparatus, which is available in a high consumption power environment and is capable of reducing consumption power.

For purposes of summarizing, certain aspects, advantages, and novel features of the invention have been described herein. It is to be understood that not all such advantages may be achieved in accordance with any one particular embodiment of the invention. Thus, the invention may be embodied or carried out in a manner that achieves or optimizes one advantage or group of advantages without achieving all advantages as may be taught or suggested herein.

In accordance with an exemplary embodiment, there is provided a stabilizer circuit for a high-voltage discharge lamp, the stabilizer comprising an electromagnetic interference (EMI) filter for eliminating static electricity from a supplied AC voltage; a rectifying unit for converting the AC voltage output from the EMI filter to a DC voltage through full-wave rectification; a power factor correction (PFC) circuit for controlling to enhance a power factor of the DC voltage output from the rectifying unit; a booster for boosting the voltage having the power factor enhanced by the PFC circuit.

The stabilizer circuit may also comprise a buck converter for converting the DC voltage boosted by the booster to a boosted or dropped DC voltage; a commutator for controlling the DC voltage output from the buck converter to provide constant current; an igniter for receiving the voltage from the commutator to generate a high voltage; a high-voltage discharge lamp turned on by the high voltage generated by the igniter; a current detector for detecting current when the high-voltage discharge lamp is turned on and then the high voltage is fed back from the igniter.

In some embodiments, the stabilizer may further comprise a voltage detector for detecting the voltage output from the buck converter; an igniter voltage controller for receiving the voltage output from the igniter and controlling the voltage not to be applied to the igniter when abnormality in the high-voltage discharge lamp occurs; a watchdog timer for comparing the detected voltage with a preset reference voltage to output a signal for sensing whether there is abnormality in the high voltage at set time intervals.

A current and voltage error sensor may be also provided for receiving the current from the current detector, the voltage from the voltage detector, and the signal for sensing whether there is abnormality in the high voltage output from the watchdog timer, to thereby sense abnormality in the voltage applied to the high-voltage discharge lamp. In a preferred embodiment, a dimming circuit connected between the voltage detector and a ground for automatically adjusting the voltage depending on ambient illuminated light and temperature is also included.

In another embodiment, the buck converter may comprise a first transformer for inducing a primary side voltage toward a secondary side according to an amount of current detected by the current detector; a transistor for controlling to connect or disconnect the voltage boosted by the booster to the igniter depending on a size of the primary side voltage of the first transformer; and a second transformer for controlling a voltage supplied from the transistor to the igniter depending on the amount of the current detected by the current detector.

BRIEF DESCRIPTION OF THE DRAWINGS

The above and other features and advantages of the present invention will become more apparent to those of ordinary skill in the art by describing in detail preferred embodiments thereof with reference to the attached drawings.

Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The present invention will now be described with reference to the accompanying drawings, in which preferred embodiments of the invention are shown. However, the invention should not be construed as limited to only the embodiments set forth herein. Rather, these embodiments are presented as teaching examples.

Numerous specific details are set forth to provide a thorough description of various embodiments of the invention. Certain embodiments of the invention may be practiced without these specific details or with some variations in detail. In some instances, certain features are described in less detail so as not to obscure other aspects of the invention. The level of detail associated with each of the elements or features should not be construed to qualify the novelty or importance of one feature over the others.

Figure 1:
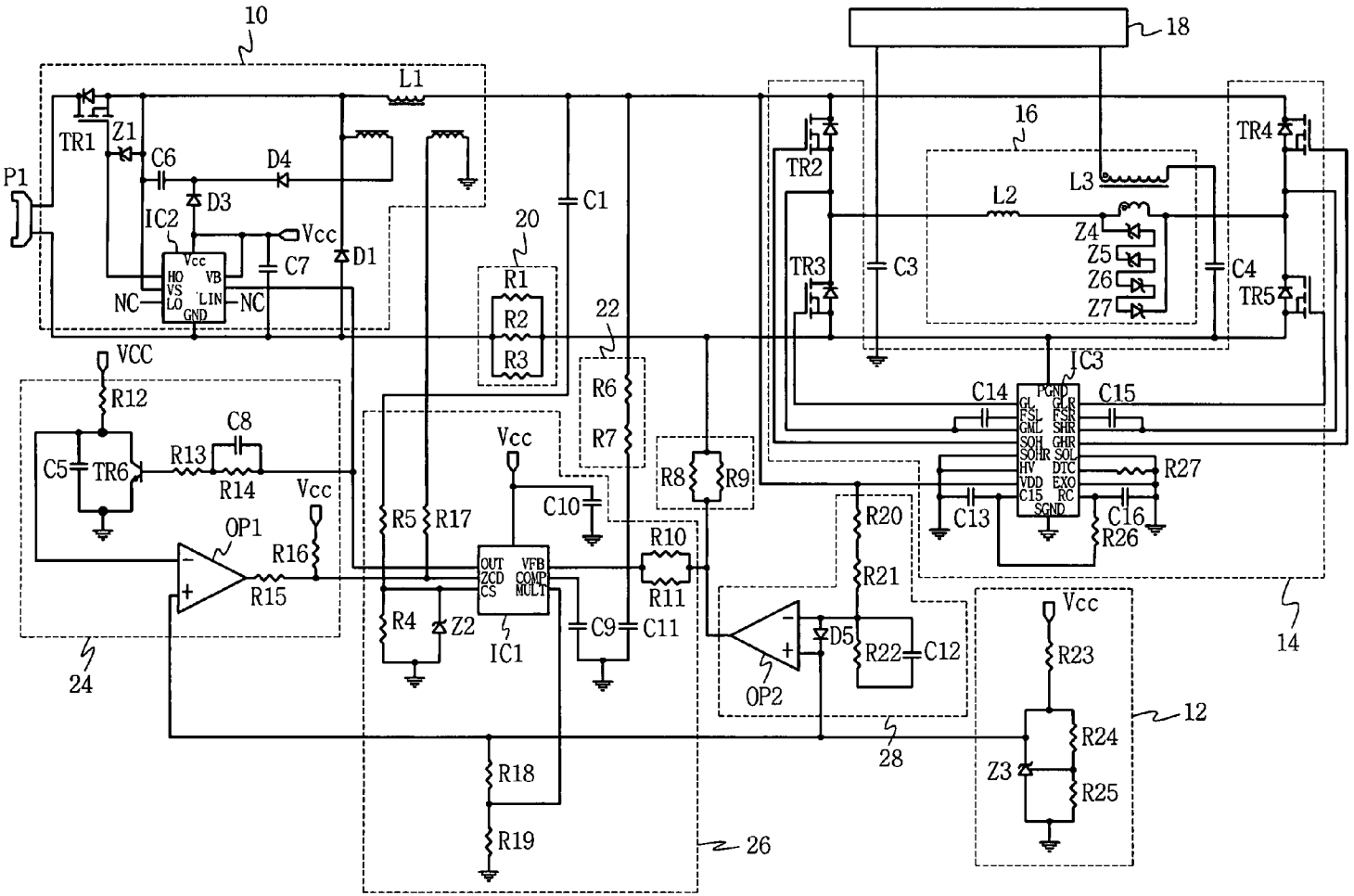
FIG. 1(PRIOR ART)
FIG. 1 is a circuit diagram of a conventional stabilizer for a high-voltage discharge lamp.
Figure 2:
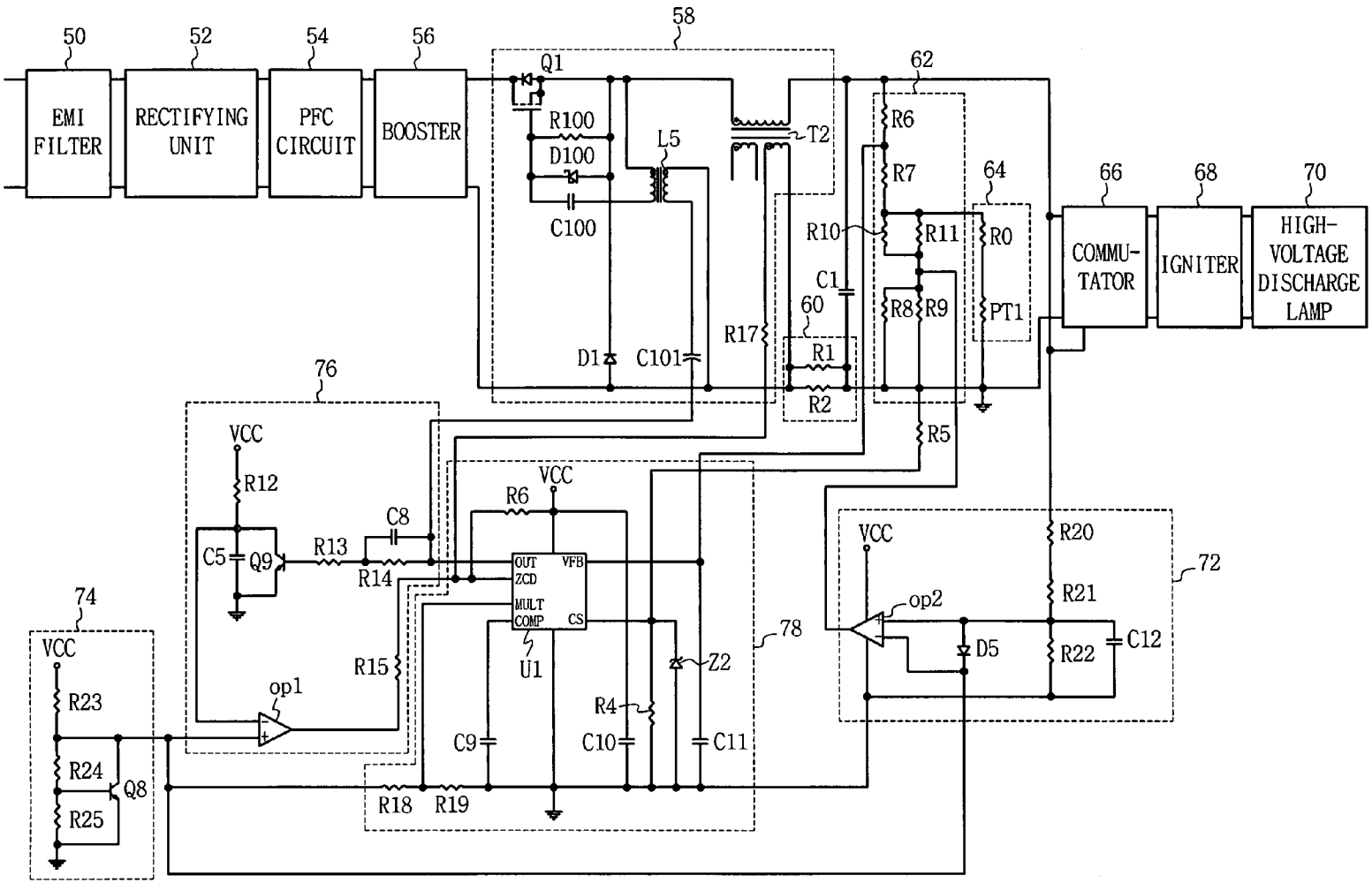
FIG. 2 is a circuit diagram of a stabilizer for a high-voltage discharge lamp according to an embodiment of the present invention.

Referring to FIG. 2, a stabilizer for a high-voltage discharge apparatus according to an embodiment of the present invention comprises an electromagnetic interference (EMI) filter 50 for eliminating static electricity from a supplied AC voltage; a rectifying unit 52 for converting the AC voltage output from the EMI filter 50 to a DC voltage through full-wave rectification; a power factor correction (PFC) circuit 54 for controlling to enhance a power factor of the DC voltage output from the rectifying unit 52.

In one embodiment, the stabilizer further comprises a booster 56 for boosting the voltage having the power factor enhanced by the PFC circuit 54. A buck converter 58 may be also provided that comprises a transistor Q1, resistors R17 and R100, capacitors C100 and C101, a diode D100, and transformers L5 and T2. The buck converter 58 is configured for converting the DC voltage boosted by the booster 56 to a boosted or dropped DC voltage.

A commutator 66 may be also provided for controlling the DC voltage output from the buck converter 58 to provide constant current. The stabilizer may further comprise an igniter 68 for receiving the voltage from the commutator 66 and generating a high voltage; a high-voltage discharge lamp 70 turned on by the high voltage generated by the igniter 68; a current detector 60 for detecting an amount of current using resistors R1 and R2 when the high-voltage discharge lamp 70 is turned on and then the high voltage is fed back from the igniter 68.

In certain embodiments, a voltage detector 62 may be included for detecting the voltage output from the buck converter 58 using resistors R6 to R11; an igniter voltage controller 72 including resistors R20, R21 and R22, a diode D5, a capacitor C12 and an operational amplifier OP2 may be provided for receiving the voltage output from the igniter 68, and controlling the voltage such that the voltage is not applied to the igniter 68 when abnormality in the high-voltage discharge lamp 70 occurs.

A system reference voltage generator 74 including resistors R23, R24 and R25 may be configured for generating a set reference voltage Vref; a watchdog timer 76 may be also provided for comparing the detected voltage with the reference voltage generated by the reference voltage generator 74 to output a signal for sensing whether there is abnormality in the high voltage at set time intervals.

In one or more embodiments, the stabilizer further comprises a current and voltage error sensor 78 including resistors R4, R6, R18 and R19, capacitors C8, C9, C10 and C11, a Zener diode Z2 and a current and voltage control logic U1 for receiving the current from the current detector 60 and the voltage from the voltage detector 62 to sense abnormality in the voltage applied to the high-voltage discharge lamp 70 at time intervals set by the watchdog timer 76, for example.

Furthermore, a dimming circuit 64 having a resistor R0 and an automatic potentiometer PT1 connected in series between the voltage detector 62 and a ground may be included for automatically adjusting the voltage depending on ambient illuminated light and temperature.

Referring to FIG. 2, in an exemplary embodiment, when an AC voltage is supplied, the electromagnetic interference (EMI) filter 50 eliminates static electricity from the AC voltage. The rectifying unit 52 converts the AC voltage output from the EMI filter 50 to a DC voltage through full-wave rectification and outputs the DC voltage to the power factor correction (PFC) circuit 54.

Preferably, the PFC circuit 54 controls and enhances a power factor of the DC voltage output from the rectifying unit 52. The booster 56 boosts the voltage having the power factor enhanced by the PFC circuit 54. The voltage boosted by the booster 56 is applied to the commutator 66 via a transistor Q1 and a transformer T2 of the buck converter 58.

The commutator 66 receives the voltage boosted by the booster 56 via the transistor Q1 and the transformer T2 of the buck converter 58 and controls the boosted voltage to supply constant current to the igniter 68. The igniter 68 receives the voltage output from the commutator 66 and generates a high voltage to turn the high-voltage discharge lamp 70 on.

When the high-voltage discharge lamp 70 is turned on, the current and voltage sensing control logic U1 outputs a frequency signal having a constant duty cycle at an output terminal OUT to the watchdog timer 76. In the watchdog timer 76, a transistor Q9 is turned on or off depending on the frequency signal applied to the base and applies a voltage Vcc or a ground voltage to an inverting terminal (−) of an operational amplifier OP1.

The operational amplifier OP1, preferably, compares the reference voltage generated by the reference voltage generator 74 to the signal received from the transistor Q9 to output a signal having a reversed phase with respect to the frequency signal generated by the current and voltage sensing control logic U1.

Further, when the high-voltage discharge lamp 70 is turned on, current fed back from the igniter 68 is detected by the current detector 60 composed of the resistors R1 and R2. When a high level of current is detected by the current detector 60, a primary side voltage at the transformer L5 is not induced toward a secondary side. When the primary side voltage at the first transformer L5 is not induced toward the secondary side, the output voltage of the first transformer L5 is lowered and the transistor Q1 is turned off.

In one embodiment, when the voltage is not induced toward the secondary side of the first transformer L5, the current fed back through the current detector 60 is pumped to a capacitor C101 via the secondary side of the first transformer L5 and a high voltage is applied to the base of the transistor Q9. Accordingly, the transistor Q9 is turned on and the ground signal is applied to the inverting terminal (−) of the operational amplifier OP1.

In response to the ground signal, the operational amplifier OP1 continuously outputs a high signal at an output terminal to the zero crossing terminal ZCD of the current and voltage sensing control logic U1. Preferably, the voltage fed back from the igniter 68 is detected by the voltage detector 62 (comprising the resistors R6 and R7 and the resistors R8, R9, R10 and R11, for example) and is applied to a feedback voltage input terminal VFB of the current and voltage sensing control logic U1.

In a preferred embodiment, current flowing into a connection node between the resistor R4 and the resistor R5 is applied to a current sensing input terminal CS of the current and voltage sensing control logic U1. The current and voltage sensing control logic U1 senses that there is abnormality in the high voltage applied to the high-voltage discharge lamp 70 when the signal applied to the zero crossing terminal ZCD is set and kept to either high or low.

In response to the high-voltage discharge lamp 70 being turned on, the feedback voltage from the igniter 68 is applied to a non-inverting terminal (+) of the operational amplifier OP2 via the resistors R20 and R21. The operational amplifier OP2 compares the feedback voltage, which is applied from the igniter 68 via the resistors R20 and R21, to the reference voltage at the inverting terminal (−).

In one embodiment, if the feedback voltage is higher due to abnormality in the igniter 68 or the high-voltage discharge lamp 70, the operational amplifier OP2 outputs a high voltage at the output terminal to increase a voltage at a connection node between the resistor R11 and the resistor R9, such that the voltage is not applied from the buck converter 58 to the igniter 68.

The operational amplifier OP2 compares the feedback voltage, which is applied from the igniter 68 via the resistors R20 and R21, to the reference voltage at the inverting terminal (−). When the feedback voltage is lower due to normal operation of the igniter 68 or the high-voltage discharge lamp 70, the operational amplifier OP2 outputs a low voltage at the output terminal to decrease the voltage at the connection node between the resistor R1 and the resistor R9, such that the voltage is applied from the buck converter 58 to the igniter 68.

As described above, when the voltage applied to the high-voltage discharge lamp 70 is controlled, it may be changed depending on temperature and illuminated light. The dimming circuit 64 comprises the resistor R0 and the automatic potentiometer PT1 between the voltage detector 62 and the ground and automatically changes the voltage of the voltage detector 62 depending on the ambient temperature or illuminated light.

In one embodiment, the dimming circuit 64 decreases the voltage of the voltage detector 62 when the ambient temperature is high and the illuminated light is bright, for example, and increases the voltage of the voltage detector 62 when the ambient temperature is low and the illuminated light is dark. As such, the dimming circuit 64 controls the voltage applied to the high-voltage discharge lamp 70 depending on the ambient temperature or the illuminated light.

In a preferred embodiment, a temperature sensor and a light sensor are connected to the automatic potentiometer PT1 so that the automatic potentiometer PT1 automatically controls the voltage depending on the temperature and the illuminated light. Accordingly, using the transformer instead of an integrated circuit (IC) chip, it is possible to control the voltage in the buck converter and prevent damage to the buck converter's components when the power applied to the high-voltage discharge lamp increases to 250 W or higher. As provided, it is also possible to reduce power consumption and increase efficiency by controlling the driving voltage of the high-voltage discharge lamp based on the ambient temperature and the illuminated light through the dimming circuit.

The invention has been described using preferred exemplary embodiments. However, it is to be understood that the scope of the invention is not limited to the disclosed embodiments. The scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

These and various other adaptations and combinations of the embodiments disclosed are within the scope of the invention and are further defined by the claims and their full scope of equivalents.

What is claimed is:

1. An electronic stabilizer for a high-voltage discharge lamp, comprising:

a rectifying unit for converting an AC voltage to a DC voltage through full-wave rectification;

a power factor correction (PFC) circuit for controlling a power factor of the DC voltage output from the rectifying unit;

a booster for boosting the voltage having the power factor controlled by the PFC circuit;

a buck converter for converting the DC voltage boosted by the booster to a modified DC voltage;

a commutator for controlling the DC voltage output from the buck converter to provide constant current;

an igniter for receiving the voltage output from the commutator to generate a high voltage, wherein the high-voltage discharge lamp is turned on by the high voltage generated by the igniter;

a current detector for detecting current in response to the high-voltage discharge lamp being turned on and the high voltage being fed back from the igniter;

a voltage detector for detecting the voltage output from the buck converter;

an igniter voltage controller for receiving the voltage output from the igniter and controlling the voltage so that the voltage is not applied to the igniter when abnormality in the high-voltage discharge lamp occurs;

a watchdog timer for comparing the detected voltage with a preset reference voltage to output a signal for sensing whether there is abnormality in the high voltage at set time intervals; and a current and voltage error sensor for receiving the current from the current detector, the voltage from the voltage detector, and a signal for sensing whether there is abnormality in the high voltage output from the watchdog timer, to thereby sense abnormality in the voltage applied to the high-voltage discharge lamp; and a dimmmg circuit connected between the voltage detector and a ground for automatically adjusting the voltage depending on ambient illuminated light and temperature.

2. The electronic stabilizer according to claim 1, further comprising an electro-magnetic interference (EMI) filter coupled to the rectifying unit for eliminating static electricity from a supplied AC voltage.

3. The electronic stabilizer according to claim 1, wherein the buck converter comprises:

a first transformer for inducing a primary side voltage toward a secondary side according to an amount of current detected by the current detector;

a transistor for controlling connection of the voltage boosted by the booster to the igniter based on a size of the primary side voltage of the first transformer; and a second transformer for controlling a voltage supplied from the transistor to the igniter based on the level of the current detected by the current detector.

4. A method of stabilizing a high-voltage discharge apparatus, the method comprising:

converting an AC voltage to a first DC voltage through full-wave rectification;

controlling a power factor of the first DC voltage;

boosting the first DC voltage;

converting the boosted first DC voltage to a second DC voltage;

controlling the second DC voltage to provide a constant current;

generating a high voltage in response to receiving the second DC voltage, wherein a high-voltage discharge lamp is turned on by the generated high voltage;

detecting a first current in response to the high-voltage discharge lamp being turned on;

monitoring the second DC voltage;

controlling the high voltage so that the high voltage is not applied to an igniter for generating the high voltage, when abnormality in the high-voltage discharge lamp occurs;

comparing the second DC voltage with a threshold voltage to output a signal indicating whether there is abnormality in the high voltage; and receiving a signal indicating whether there is abnormality in the high voltage, to thereby sense abnormality in the voltage applied to the high-voltage discharge lamp; and automatically adjusting the voltage depending on ambient illuminated light and temperature.

5. The method of claim 4, wherein the converting of the boosted first DC voltage to a second DC voltage comprises:

inducing a primary side voltage toward a secondary side based on a detected current level;

controlling the boosted first DC voltage based on the primary side voltage of the first transformer; and controlling a voltage supplied for generating the high voltage based on the level of the detected current level.

6. The method of claim 4, further comprising eliminating static electricity from the supplied AC voltage.

* * * * *